US009175890B2

(12) United States Patent
Tamura et al.

(10) Patent No.: US 9,175,890 B2
(45) Date of Patent: Nov. 3, 2015

(54) OUTDOOR UNIT FOR AIR-CONDITIONING APPARATUS, AND AIR-CONDITIONING APPARATUS

(71) Applicant: FUJITSU GENERAL LIMITED, Kawasaki-shi, Kanagawa (JP)

(72) Inventors: Hideya Tamura, Kawasaki (JP); Takahiro Matsunaga, Kawasaki (JP); Shinju Watanabe, Kawasaki (JP); Keito Kawai, Kawasaki (JP); Takashi Kimura, Kawasaki (JP); Kotaro Toya, Kawasaki (JP); Yasuhiro Oka, Kawasaki (JP); Ken Nakashima, Kawasaki (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 309 days.

(21) Appl. No.: 13/933,608

(22) Filed: Jul. 2, 2013

(65) Prior Publication Data

US 2014/0007601 A1 Jan. 9, 2014

(30) Foreign Application Priority Data

Jul. 9, 2012 (JP) ..... 2012-153762

(51) Int. Cl.

| | |
|---|---|
| ***F25B 29/00*** | (2006.01) |
| ***F24F 1/20*** | (2011.01) |
| ***F24F 1/46*** | (2011.01) |
| ***F24F 11/00*** | (2006.01) |

(52) U.S. Cl.
CPC ..... *F25B 29/003* (2013.01); *F24F 1/20* (2013.01); *F24F 1/46* (2013.01); *F24F 11/006* (2013.01)

(58) Field of Classification Search
CPC ..... F24F 1/20; F24F 1/46; F24F 11/006; F25B 29/003; F25B 2313/0292; F25B 2600/11; F25B 2600/111; F25B 2700/1933
USPC ..... 62/159, 160, 181, 183
See application file for complete search history.

(56) References Cited

U.S. PATENT DOCUMENTS

2013/0019622 A1 * 1/2013 Nakashima et al. ..... 62/160
2013/0081417 A1 * 4/2013 Tamura et al. ..... 62/160

FOREIGN PATENT DOCUMENTS

JP 2004-286253 10/2004

* cited by examiner

*Primary Examiner* — Marc Norman
(74) *Attorney, Agent, or Firm* — Rankin, Hill & Clark LLP

(57) ABSTRACT

An outdoor unit for an air-conditioning apparatus includes: a compressor; an outdoor fan; a plurality of outdoor heat exchangers coupled to a plurality of indoor units; a switching member configured to switch functions of the outdoor heat exchangers to either condensers or evaporators by switching of coupling states between the compressor and the outdoor heat exchangers; and a control unit configured to calculate a low pressure saturation temperature during a cooling operation or a cooling-main operation, and configured to cause all of the plurality of outdoor heat exchangers to serve as condensers by controlling the switching member when a state in which an open-air temperature is lower than the low pressure saturation temperature continues for a predetermined time.

8 Claims, 3 Drawing Sheets

OUTDOOR UNIT FOR AIR-CONDITIONING APPARATUS, AND AIR-CONDITIONING APPARATUS

CROSS-REFERENCE TO RELATED APPLICATION

This application is based on Japanese Patent Application No. 2012-153762 filed with the Japan Patent Office on Jul. 9, 2012, the entire contents of which are hereby incorporated by reference.

BACKGROUND

1. Technical Field

The present disclosure relates to an outdoor unit for an air-conditioning apparatus, and an air-conditioning apparatus.

2. Related Art

Heretofore, an air-conditioning apparatus having at least one outdoor unit and a plurality of indoor units has been known. The indoor units are coupled in parallel to the outdoor unit via a plurality of refrigerant pipes. The air-conditioning apparatus is capable of allowing the indoor units to be individually set to (or select) either a cooling operation or a heating operation and allowing them to be simultaneously operated (a so-called "cooling/heating-free operation").

Such an air-conditioning apparatus is described in, for example, JP-A-2004-286253 (Patent Document 1). This air-conditioning apparatus is provided with one outdoor unit, two indoor units, and two electromagnetic valve units. The outdoor unit is provided with a compressor, an accumulator, an oil separator, a receiver tank, and two outdoor heat exchangers. The outdoor unit also includes an outdoor expansion valve, a discharge valve, and an intake valve coupled to each of the outdoor heat exchangers. Each of the indoor units is provided with an indoor heat exchanger. Each of the electromagnetic valve units is provided with two electromagnetic valves. The electromagnetic valve units switch the couplings of the respective indoor heat exchangers to the discharge side (high-pressure side) of the compressor or the intake side (low-pressure side) of the compressor.

In the air-conditioning apparatus disclosed in Patent Document 1, the outdoor unit, the indoor units, and the electromagnetic valve units are coupled via refrigerant pipes as follows. A discharge pipe coupled to the discharge side of the compressor is coupled to the oil separator and branched therefrom. One branch pipe is coupled to the outdoor heat exchangers via the discharge valves. The other branch pipe is coupled to the indoor heat exchangers via the electromagnetic valve units. The discharge pipe and the branch pipes constitute a high-pressure gas pipe.

An intake pipe coupled to the intake side of the compressor is coupled to the accumulator and branched therefrom. One branch pipe from the accumulator is coupled to the outdoor heat exchangers via the intake valves. The other branch pipe from the accumulator is coupled to the indoor heat exchangers via the electromagnetic valve units. The intake pipe and the branch pipes constitute a low-pressure gas pipe.

The outdoor heat exchangers each have two coupling ports. To one of the coupling ports, the discharge valves and the intake valves are coupled. To the other of the coupling ports, one end of a branched refrigerant pipe is coupled via the outdoor expansion valves. The other end of the refrigerant pipe is coupled to the receiver tank and branched therefrom. The branch pipes from the receiver tank are coupled to the coupling ports of the indoor heat exchangers on the side on which the electromagnetic valve units are not coupled. The refrigerant pipe and the branch pipes constitute a liquid pipe.

In the air-conditioning apparatus described above, the coupling between the indoor heat exchangers and the compressor is switched by opening or closing the electromagnetic valves of the electromagnetic valve units. Namely, by opening or closing the electromagnetic valves, the coupling between the indoor heat exchangers and the discharge side or intake side of the compressor is switched. Thus, each of the indoor heat exchangers can be caused to individually serve as a condenser or an evaporator. Thus, the cooling operation or the heating operation can be selected for the individual indoor units while the indoor units are simultaneously operated.

SUMMARY

An outdoor unit for an air-conditioning apparatus includes: a compressor; an outdoor fan; a plurality of outdoor heat exchangers coupled to a plurality of indoor units; a switching member configured to switch functions of the outdoor heat exchangers to either condensers or evaporators by switching of coupling states between the compressor and the outdoor heat exchangers; and a control unit configured to calculate a low pressure saturation temperature during a cooling operation or a cooling-main operation, and configured to cause all of the plurality of outdoor heat exchangers to serve as condensers by controlling the switching member when a state in which an open-air temperature is lower than the low pressure saturation temperature continues for a predetermined time.

DETAILED DESCRIPTION

Figure 1:
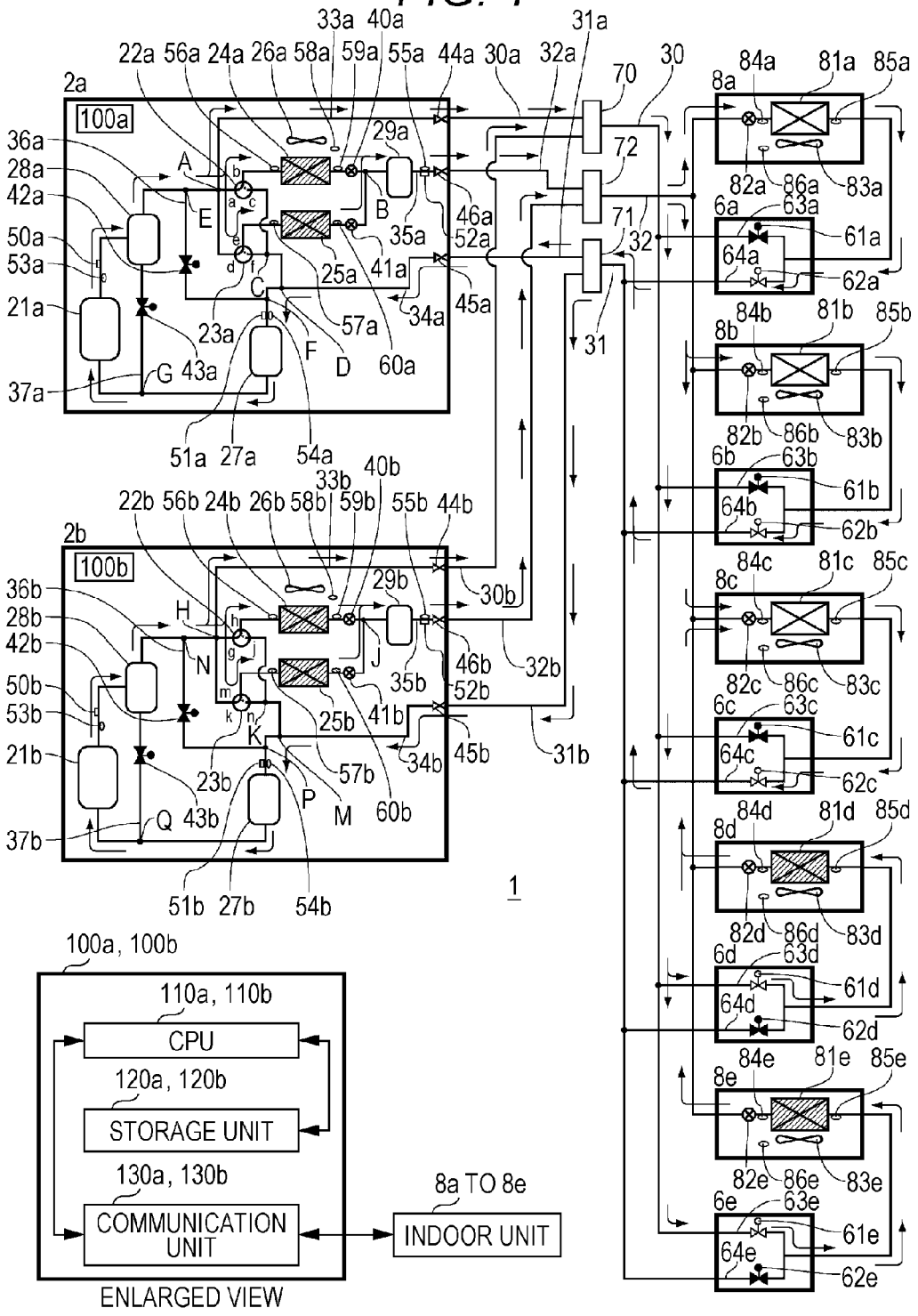
FIG. 1 is a refrigerant circuit diagram illustrating a flow of refrigerant when a cooling-main operation is performed according to an example of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In an air-conditioning apparatus such as discussed above, all (such as two) of the indoor units may perform the cooling operation, or one indoor unit may perform the heating operation while the remaining indoor units may perform the cooling operation. In these cases, the capacity required from the indoor unit performing the cooling operation may be greater than the capacity required from the indoor unit performing the heating operation (hereafter referred to as a "cooling-main operation"). In this case, the opening and closing of the various valves are controlled so that the outdoor heat exchangers can serve as condensers.

When the air-conditioning apparatus performs the cooling operation or the cooling-main operation, the open-air temperature may be decreased. As a result, the condensation temperature may be lowered, resulting in a decrease in the high pressure (pressure of the refrigerant flowing in the high-pressure gas pipe). In such a case, the rotation speed of the compressor is increased to a performance upper-limit rotation speed so as to increase the lowered high pressure. However, increasing the rotation speed of the compressor may lead to a decrease in the low pressure (pressure of refrigerant flowing in the low-pressure gas pipe) below a target low pressure. There is also the case in which, relative to the evaporation capacity of the indoor heat exchanger serving as an evaporator, the condensation capacity of the indoor heat exchanger and the outdoor heat exchangers serving as condensers is excessive. In this case, the condensation capacity of the indoor heat exchanger and the outdoor heat exchangers is decreased.

In the above case, a flow passage switching means corresponding to one of the outdoor heat exchangers, which serve as condensers, may be switched so as to couple the one outdoor heat exchanger to the low-pressure side (whereby the one outdoor heat exchanger is caused to serve as an evaporator). In addition, the outdoor expansion valve corresponding to the one outdoor heat exchanger may be fully closed so as not to use the one outdoor heat exchanger. Thus, by not using one of the outdoor heat exchangers, the number of the outdoor heat exchangers that serve as condensers can be reduced. In this way, condensation capacity can be decreased and the low pressure can be increased to approach the target low pressure by the decrease in condensation capacity.

However, in the above approach, the outdoor heat exchanger that is not used is coupled on the low-pressure side. Thus, some of the refrigerant that has been evaporated in the indoor units and returned back into the outdoor unit may flow into the unused outdoor heat exchanger and remain therein. In this case, if the open-air temperature is lower than the low pressure saturation temperature of the refrigerant (such as −10° C.), the refrigerant remaining in the unused outdoor heat exchanger may be condensed, producing liquid refrigerant (i.e., so-called refrigerant stagnation is caused). The stagnation of the refrigerant in the unused outdoor heat exchanger may result in a lack of refrigerant in the indoor units. The lack of refrigerant decreases the cooling capacity or heating capacity of the indoor units.

An object of the present disclosure is to provide an air-conditioning apparatus that can suppress the decrease in cooling capacity and/or heating capacity due to a lack of refrigerant by eliminating or mitigating the refrigerant stagnation in the unused outdoor heat exchanger.

An outdoor unit for an air-conditioning apparatus according to the present disclosure includes: a compressor; an outdoor fan; a plurality of outdoor heat exchangers coupled to a plurality of indoor units; a switching member configured to switch functions of the outdoor heat exchangers to either condensers or evaporators by switching of coupling states between the compressor and the outdoor heat exchangers; and a control unit configured to calculate a low pressure saturation temperature during a cooling operation or a primarily cooling operation, and configured to cause all of the plurality of outdoor heat exchangers to serve as condensers by controlling the switching member when a state in which an open-air temperature is lower than the low pressure saturation temperature continues for a predetermined time.

According to this outdoor unit, when the probability of refrigerant stagnation in the outdoor heat exchanger at rest is increased during the cooling operation or the cooling-main operation, all of the outdoor heat exchangers including the outdoor heat exchanger at rest are caused to serve as condensers. Thus, the stagnated refrigerant can be caused to flow out of the outdoor heat exchanger. Namely, refrigerant stagnation can be mitigated or eliminated, so that the lack of refrigerant in the indoor units performing the cooling operation can be remedied or eliminated. As a result, the decrease in cooling and/or heating capacity can be suppressed.

In the following, an embodiment (example) of the present disclosure will be described with reference to the attached drawings. In the air-conditioning apparatus according to the present example, five indoor units are coupled in parallel to two outdoor units. In the air-conditioning apparatus, the operation state of each indoor unit can be set (selected) for the cooling operation or the heating operation, and the indoor units can be simultaneously operated (the so-called "cooling/heating-free operation).

The present disclosure is not limited to the following embodiment (example). The present disclosure may be variously modified without departing from the scope of the disclosure.

As illustrated in FIG. 1, an air-conditioning apparatus 1 according to the present example is provided with two outdoor units 2*a* and 2*b*, five indoor units 8*a* to 8*e*, five switching units 6*a* to 6*e*, and branching units 70, 71, and 72. The outdoor units 2*a* and 2*b*, the indoor units 8*a* to 8*e*, the switching units 6*a* to 6*e*, and the branching units 70 to 72 are mutually coupled via a high-pressure gas pipe 30, high-pressure gas branch pipes 30*a* and 30*b*, a low-pressure gas pipe 31, low-pressure gas branch pipes 31*a* and 31*b*, a liquid pipe 32, and liquid branch pipes 32*a* and 32*b*. Thus, a refrigerant circuit for the air-conditioning apparatus 1 is produced.

In the air-conditioning apparatus 1, various operations can be selected depending on the open/close state of various valves disposed at the outdoor units 2*a* and 2*b* and the switching units 6*a* to 6*e*. In the heating operation, all of the indoor units may perform the heating operation. In a heating-main operation, the total capacity required from the indoor units performing the heating operation is greater than the total capacity required from the indoor units performing the cooling operation. In the cooling operation, all of the indoor units may perform the cooling operation. In the cooling-main operation, the total capacity required from the indoor units performing the cooling operation is greater than the total capacity required from the indoor units performing the heating operation. In the following description, the cooling-main operation among the above operations will be described by way of example with reference to FIG. 1.

In the refrigerant circuit illustrated in FIG. 1, the indoor units 8*a* to 8*c* are performing the cooling operation while the indoor units 8*d* and 8*e* are performing the heating operation. First, the outdoor units 2*a* and 2*b* will be described. The outdoor units 2*a* and 2*b* have identical configurations. Thus, in the following description, the configuration of the outdoor unit 2*a* will be described and the detailed description of the outdoor unit 2*b* will be omitted.

As illustrated in FIG. 1, the outdoor unit 2*a* is provided with a compressor 21*a*; a first three-way valve 22*a* and a second three-way valve 23*a* as flow passage switching units (switching members); a first outdoor heat exchanger 24*a*; a second outdoor heat exchanger 25*a*; an outdoor fan 26*a*; an accumulator 27*a*; an oil separator 28*a*; a receiver tank 29*a*; a first outdoor expansion valve 40*a* coupled to the first outdoor heat exchanger 24*a*; a second outdoor expansion valve 41*a* coupled to the second outdoor heat exchanger 25*a*; a hot gas bypass pipe 36*a*; a first electromagnetic valve 42*a* disposed at the hot gas bypass pipe 36*a*; an oil return pipe 37*a*; a second electromagnetic valve 43*a* disposed at the oil return pipe 37*a*; and closing valves 44*a* to 46*a*. The first outdoor expansion valve 40*a* and the second outdoor expansion valve 41*a* are flow rate adjustment units (switching members) according to the present disclosure.

The compressor 21*a* is driven by a motor (not shown) whose rotation speed is controlled by an inverter. Namely, the compressor 21*a* is a capacity variable compressor with variable operation capacity. As illustrated in FIG. 1, the discharge side of the compressor 21*a* is coupled to the inflow side of the oil separator 28*a* via a refrigerant pipe. The outflow side of the oil separator 28*a* is coupled to the closing valve 44*a* via an outdoor unit high-pressure gas pipe 33*a*. The intake side of the compressor 21*a* is coupled to the outflow side of the accumulator 27*a* via a refrigerant pipe. The inflow side of the accumulator 27*a* is coupled to the closing valve 45*a* via an outdoor unit low-pressure gas pipe 34*a*.

The first three-way valve 22*a* and the second three-way valve 23*a* are valves configured to switch the direction of flow of refrigerant. Namely, the first three-way valve 22*a* and the second three-way valve 23*a* switch the coupling of one of refrigerant inlet/outlet openings of the corresponding outdoor heat exchangers 24*a* and 25*a* to the discharge side (refrigerant discharge opening) or the intake side (refrigerant intake opening) of the compressor 21*a*.

In other words, the first three-way valve 22*a* switches the function of the outdoor heat exchanger 24*a* to either a condenser or an evaporator by switching of a coupling state between the outdoor heat exchanger 24*a* and the compressor 21*a*. On the other hand, the second three-way valve 23*a* switches the function of the outdoor heat exchanger 25*a* to either a condenser or an evaporator by switching of a coupling state between the outdoor heat exchanger 25*a* and the compressor 21*a*.

The first three-way valve 22*a* has three ports a, b, and c. The second three-way valve 23*a* has three ports d, e, and f. A refrigerant pipe coupled to the port a of the first three-way valve 22*a* is coupled to the outdoor unit high-pressure gas pipe 33*a* at a coupling point A. The port b and the first outdoor heat exchanger 24*a* are coupled via a refrigerant pipe. A refrigerant pipe coupled to the port c is coupled to the outdoor unit low-pressure gas pipe 34*a* at a coupling point D.

A refrigerant pipe coupled to the port d of the second three-way valve 23*a* is coupled at the coupling point A to the refrigerant pipe coupled to the outdoor unit high-pressure gas pipe 33*a* and the port a of the first three-way valve 22*a*. The port e and the second outdoor heat exchanger 25*a* are coupled via a refrigerant pipe. A refrigerant pipe coupled to the port f is coupled at a coupling point C to the refrigerant pipe coupled to the port c of the first three-way valve 22*a*.

The first outdoor heat exchanger 24*a* and the second outdoor heat exchanger 25*a* include a number of fins (not shown) made primarily of aluminum material and a plurality of copper pipes (not shown) in which refrigerant is circulated. As described above, one refrigerant inlet/outlet opening of the first outdoor heat exchanger 24*a* is coupled to the port b of the first three-way valve 22*a*. The other refrigerant inlet/outlet opening of the first outdoor heat exchanger 24*a* is coupled to one port of the first outdoor expansion valve 40*a* via a refrigerant pipe. The other port of the first outdoor expansion valve 40*a* is coupled to the closing valve 46*a* via an outdoor unit liquid pipe 35*a*.

One refrigerant inlet/outlet opening of the second outdoor heat exchanger 25*a* is coupled to the port e of the second three-way valve 23*a* via refrigerant pipe, as described above. The other refrigerant inlet/outlet opening of the second outdoor heat exchanger 25*a* is coupled to one port of the second outdoor expansion valve 41*a* via a refrigerant pipe. The other port of the second outdoor expansion valve 41*a* is coupled to the outdoor unit liquid pipe 35*a* at a coupling point B via a refrigerant pipe.

The first outdoor expansion valve 40*a* and the second outdoor expansion valve 41*a* are electric expansion valves driven by a pulse motor (not shown). The degree of opening of each of the outdoor expansion valves is adjusted by the number of pulses given to the pulse motor.

The outdoor fan 26*a* is disposed in the vicinity of the first outdoor heat exchanger 24*a* and the second outdoor heat exchanger 25*a*. The outdoor fan 26*a* is a propeller fan made of a resin material and is rotated by a fan motor (not shown). Open-air taken into the outdoor unit 2*a* by the outdoor fan 26*a* exchanges heat with the refrigerant in the first outdoor heat exchanger 24*a* and/or the second outdoor heat exchanger 25*a* and is then expelled outside the outdoor unit 2*a*. According to the present example, a performance upper-limit rotation speed of 900 rpm is set for the outdoor fan 26*a* (fan motor of the outdoor fan 26*a*).

The inflow side of the accumulator 27*a* is coupled to the outdoor unit low-pressure gas pipe 34*a*. The outflow side of the accumulator 27*a* is coupled to the intake side of the compressor 21*a* via a refrigerant pipe. The accumulator 27*a* separates the inflow refrigerant into gas refrigerant and liquid refrigerant. The separated gas refrigerant is suctioned into the compressor 21*a*.

The inflow side of the oil separator 28*a* is coupled to the discharge side of the compressor 21*a* via a refrigerant pipe. The outflow side of the oil separator 28*a* is coupled to the outdoor unit high-pressure gas pipe 33*a*. The oil separator 28*a* separates refrigerant oil for the compressor 21*a*, which is contained in the refrigerant discharged, from the compressor 21*a*. The separated refrigerant oil is suctioned into the compressor 21*a* via the oil return pipe 37*a* (as will be described later).

The receiver tank 29*a* is disposed between the coupling point B of the outdoor unit liquid pipe 35*a* and the closing valve 46*a*. The receiver tank 29*a* is a container that can contain the refrigerant. The receiver tank 29*a* adjusts the amount of refrigerant in the first outdoor heat exchanger 24*a* and the second outdoor heat exchanger 25*a*. Namely, the receiver tank 29*a* provides the role of a buffer. The receiver tank 29*a* has functions such as one for gas-liquid separation of the refrigerant.

One end of the hot gas bypass pipe 36*a* is coupled to the outdoor unit high-pressure gas pipe 33*a* at a coupling point E. The other end of the hot gas bypass pipe 36*a* is coupled to the outdoor unit low-pressure gas pipe 34*a* at a coupling point F. The hot gas bypass pipe 36*a* is provided with the first electromagnetic valve 42*a*. By opening or closing the first electromagnetic valve 42*a*, the state of the hot gas bypass pipe 36*a* can be switched between a refrigerant flow state and a non-refrigerant flow state.

One end of the oil return pipe 37*a* is coupled to an oil return opening of the oil separator 28*a*. The other end of the oil return pipe 37*a* is coupled at a coupling point G to a refrigerant pipe coupling the intake side of the compressor 21*a* and the outflow side of the accumulator 27*a*. The oil return pipe 37*a* is provided with the second electromagnetic valve 43*a*. By opening or closing the second electromagnetic valve 43*a*, the state of the oil return pipe 37*a* can be switched between the refrigerant flow state and the non-refrigerant flow state.

In addition, the outdoor unit 2*a* is provided with various sensors. As illustrated in FIG. 1, the refrigerant pipe coupling the discharge side of the compressor 21*a* and the oil separator 28*a* is provided with a high pressure sensor 50*a* and a discharge temperature sensor 53*a*. The high pressure sensor 50*a* (high pressure detection means, or a high-pressure detector) detects the pressure of the refrigerant discharged from the compressor 21*a*. The discharge temperature sensor 53*a* detects the temperature of the refrigerant discharged from the compressor 21*a*.

Between the coupling point F of the outdoor unit low-pressure gas pipe 34*a* and the inflow side of the accumulator 27*a*, a low pressure sensor 51*a* and an intake temperature sensor 54*a* are provided. The low pressure sensor 51*a* (low-pressure detection means, or a low-pressure detector) detects the pressure of the refrigerant suctioned into the compressor 21*a*. The intake temperature sensor 54*a* detects the temperature of the refrigerant suctioned into the compressor 21*a*.

Between the coupling point B of the outdoor unit liquid pipe 35*a* and the closing valve 46*a*, an intermediate pressure sensor 52*a* and a refrigerant temperature sensor 55*a* are provided. The intermediate pressure sensor 52*a* detects the pressure of the refrigerant flowing in the outdoor unit liquid pipe 35*a*. The refrigerant temperature sensor 55*a* detects the temperature of the refrigerant flowing in the outdoor unit liquid pipe 35*a*.

The refrigerant pipe coupling the port b of the first three-way valve 22*a* and the first outdoor heat exchanger 24*a* is provided with a first gas side refrigerant temperature sensor 56*a*. The first gas side refrigerant temperature sensor 56*a* detects the temperature of the refrigerant that flows out of the first outdoor heat exchanger 24*a* or into the first outdoor heat exchanger 24*a*.

The refrigerant pipe coupling the first outdoor heat exchanger 24*a* and the first outdoor expansion valve 40*a* is provided with a first liquid side refrigerant temperature sensor 59*a*. The first liquid side refrigerant temperature sensor 59*a* detects the temperature of the refrigerant that flows out of the first outdoor heat exchanger 24*a* or into the first outdoor heat exchanger 24*a*.

The refrigerant pipe coupling the port e of the second three-way valve 23*a* and the second outdoor heat exchanger 25*a* is provided with a second gas side refrigerant temperature sensor 57*a*. The second gas side refrigerant temperature sensor 57*a* detects the temperature of the refrigerant that flows out of the second outdoor heat exchanger 25*a* or into the second outdoor heat exchanger 25*a*.

The refrigerant pipe coupling the second outdoor heat exchanger 25*a* and the second outdoor expansion valve 41*a* is provided with a second liquid-side refrigerant temperature sensor 60*a*. The second liquid-side refrigerant temperature sensor 60*a* detects the temperature of the refrigerant that flows out of the second outdoor heat exchanger 25*a* or into the second outdoor heat exchanger 25*a*.

Around a suction opening (not shown) of the outdoor unit 2*a*, an open-air temperature sensor 58*a* is installed. The open-air temperature sensor 58*a* is an open-air temperature detection means (open-air temperature detector) that detects the temperature of open-air that flows into the outdoor unit 2*a*.

The outdoor unit 2*a* is provided with a control means (control unit) 100*a* mounted on a control substrate (not shown). The control means 100*a* includes a CPU 110*a*, a storage unit 120*a*, and a communication unit 130*a*. The CPU 110*a* receives detection signals from the sensors installed in the outdoor unit 2*a*. The CPU 110*a* also receives control signals outputted from the indoor units 8*a* to 8*e* via the communication unit 130*a*. The CPU 110*a* performs various controls on the basis of the detection signals and the control signals. For example, the CPU 110*a* performs drive control for the compressor 21*a*; switching control for the first three-way valve 22*a* and the second three-way valve 23*a*; rotation control for the fan motor of the outdoor fan 26*a*; and opening degree control for the first outdoor expansion valve 40*a* and the second outdoor expansion valve 41*a*.

The storage unit 120*a* includes a ROM and/or a RAM. The storage unit 120*a* may store a control program for the outdoor unit 2*a* and detection values corresponding to the detection signals from the sensors. The communication unit 130*a* provides an interface for enabling communications between the outdoor unit 2*a* and the indoor units 8*a* to 8*e*.

The configuration of the outdoor unit 2*b* is the same as the configuration of the outdoor unit 2*a*. Namely, the constituent elements (devices and members) of the outdoor unit 2*b* are designated by the signs designating the corresponding constituent elements of the outdoor unit 2*a* with the letter at the end of each sign changed from "a" to "b". However, the signs for the first three-way valve, the second three-way valve, and the coupling points of the refrigerant pipes are varied between the outdoor unit 2*a* and the outdoor unit 2*b*. Namely, the ports a, b, and c of the first three-way valve 22*a* of the outdoor unit 2*a* correspond to ports g, h, and j of the first three-way valve 22*b* of the outdoor unit 2*b*. The ports d, e, and f of the second three-way valve 23*a* of the outdoor unit 2*a* correspond to the ports k, m, and n of the second three-way valve 23*b* of the outdoor unit 2*b*. The coupling points A, B, C, D, E, F, and G of the outdoor unit 2*a* correspond to the coupling points H, J, K, M, N, P, and Q of the outdoor unit 2*b*.

As illustrated in FIG. 1, in the refrigerant circuit at the time of the cooling-main operation, the three-way valves are switched so that the two outdoor heat exchangers installed in each of the outdoor units 2*a* and 2*b* serve as condensers.

Specifically, the first three-way valve 22*a* of the outdoor unit 2*a* is switched to provide communication between the port a and the port b. The second three-way valve 23*a* of the outdoor unit 2*a* is switched to provide communication between the port d and the port e. The first three-way valve 22*b* of the outdoor unit 2*b* is switched to provide communication between the port g and the port h. The second three-way valve 23*b* of the outdoor unit 2*b* is switched to provide communication between the port k and the port m. In FIG. 1, the ports of the three-way valves that are in communication are indicated by solid lines. The ports that are not in communication are indicated by broken lines.

Each of the five indoor units 8*a* to 8*e* is provided with an indoor exchanger, an indoor expansion valve, and an indoor fan. Specifically, the indoor heat exchangers 81*a* to 81*e*, the indoor expansion valves 82*a* to 82*e*, and the indoor fans 83*a* to 83*e* are provided. The respective indoor units 8*a* to 8*e* have identical configurations. Thus, in the following description, only the configuration of the indoor unit 8*a* will be described, and the description of the other indoor units 8*b* to 8*e* will be omitted.

One refrigerant inlet/outlet opening of the indoor heat exchanger 81*a* is coupled to one port of the indoor expansion valve 82*a* via a refrigerant pipe. The other refrigerant inlet/outlet opening of the indoor heat exchanger 81*a* is coupled to the switching unit 6*a* (as will be described later) via a refrigerant pipe. When the indoor unit 8*a* performs the cooling operation, the indoor heat exchanger 81*a* serves as an evaporator. When the indoor unit 8*a* performs the heating operation, the indoor heat exchanger 81*a* serves as a condenser.

One port of the indoor expansion valve 82*a* is coupled to the indoor heat exchanger 81*a*, as described above. The other port of the indoor expansion valve 82*a* is coupled to the liquid pipe 32. When the indoor heat exchanger 81*a* serves as an evaporator, the degree of opening of the indoor expansion valve 82*a* is adjusted in accordance with the cooling capacity required from the indoor unit 8*a*. When the indoor heat exchanger 81*a* serves as a condenser, the degree of opening of the indoor expansion valve 82*a* is adjusted in accordance with the heating capacity required from the indoor unit 8*a*.

The indoor fan 83*a* is rotated by a fan motor (not shown). The indoor air taken into the indoor unit 8*a* by the indoor fan 83*a* exchanges heat with refrigerant in the indoor heat exchanger 81*a* and is then supplied indoor.

In addition to the configuration described above, the indoor unit 8*a* is provided with various sensors. Namely, the indoor unit 8*a* is provided with refrigerant temperature sensors 84*a* and 85*a*, and a room temperature sensor 86*a*. The refrigerant temperature sensor 84*a* is disposed at the refrigerant pipe to the indoor heat exchanger 81*a* on the side closer to the indoor expansion valve 82*a* for detecting the temperature of refrigerant. The refrigerant temperature sensor 85*a* is disposed at the refrigerant pipe to the indoor heat exchanger 81*a* on the side closer to the switching unit 6*a* for detecting the temperature of refrigerant. The room temperature sensor 86*a* is installed in the vicinity of an indoor air suction opening (not shown) of the indoor unit 8*a* for detecting the temperature of the indoor air that flows into the indoor unit 8*a*, i.e., the indoor temperature.

The configuration of the indoor units 8*b* to 8*e* is the same as the configuration of the indoor unit 8*a*. Namely, the constituent elements (devices and members) of the indoor units 8*b* to 8*e* are designated by the corresponding signs designating the constituent elements of the indoor unit 8*a* with the letter "a" replaced with "b", "c", "d", or "e".

The air-conditioning apparatus 1 is provided with the five switching units 6*a* to 6*e* corresponding to the five indoor units 8*a* to 8*e*. Each of the switching units 6*a* to 6*e* is provided with two electromagnetic valves, a first diversion pipe, and a second diversion pipe. Specifically, the electromagnetic valves 61*a* to 61*e*, the electromagnetic valves 62*a* to 62*e*, the first diversion pipes 63*a* to 63*e*, and the second diversion pipes 64*a* to 64*e* are provided. The switching units 6*a* to 6*e* have identical configurations. Thus, in the following description, only the configuration of the switching unit 6*a* will be described and the description of the other switching units 6*b* to 6*e* will be omitted.

One end of the first diversion pipe 63*a* is coupled to the high-pressure gas pipe 30. One end of the second diversion pipe 64*a* is coupled to the low-pressure gas pipe 31. The other end of the first diversion pipe 63*a* and the other end of the second diversion pipe 64*a* are mutually coupled at a coupling point. The coupling point is coupled to the indoor heat exchanger 81*a* via a refrigerant pipe. The first diversion pipe 63*a* is provided with the electromagnetic valve 61*a*. The second diversion pipe 64*a* is provided with the electromagnetic valve 62*a*. By opening or closing the electromagnetic valve 61*a* and the electromagnetic valve 62*a*, the refrigerant flow passage in the refrigerant circuit can be switched. Namely, by opening or closing the electromagnetic valve 61*a* and the electromagnetic valve 62*a*, the coupling of the indoor heat exchanger 81*a* of the indoor unit 8*a* corresponding to the switching unit 6*a* to the compressor 21*a* and/or the compressor 21*b* can be switched. Specifically, depending on the opening or closing of the electromagnetic valve 61*a* and the electromagnetic valve 62*a*, the indoor heat exchanger 81*a* is coupled to the discharge side (high-pressure gas pipe 30 side) of the compressor 21*a* and/or the compressor 21*b*, or the indoor heat exchanger 81*a* is coupled to the intake side (low-pressure gas pipe 31 side) of the compressor 21*a* and/or the compressor 21*b*.

As mentioned above, the switching units 6*b* to 6*e* have the same configuration as the configuration of the switching unit 6*a*. Namely, the constituent elements (devices and members) of the switching units 6*b* to 6*e* are designated by the signs designating the corresponding constituent elements of the switching unit 6*a* with the last letter "a" replaced with "b", "c", "d", or "e".

With reference to FIG. 1, the coupling of the outdoor units 2*a* and 2*b*, the indoor units 8*a* to 8*e* and the switching units 6*a* to 6*e* with the high-pressure gas pipe 30, the high-pressure gas branch pipes 30*a* and 30*b*, the low-pressure gas pipe 31, the low-pressure gas branch pipes 31*a* and 31*b*, the liquid pipe 32, the liquid branch pipes 32*a* and 32*b*, and the branching units 70 to 72 will be described.

To the closing valve 44*a* of the outdoor unit 2*a*, one end of the high-pressure gas branch pipe 30*a* is coupled. To the closing valve 44*b* of the outdoor unit 2*b*, one end of the high-pressure gas branch pipe 30*b* is coupled. The other end of the high-pressure gas branch pipe 30*a* and the other end of the high-pressure gas branch pipe 30*b* are coupled to the branching unit 70. To the branching unit 70, one end of the high-pressure gas pipe 30 is coupled. The other end of the high-pressure gas pipe 30 is branched and coupled to the first diversion pipes 63*a* to 63*e* of the switching units 6*a* to 6*e*.

To the closing valve 45*a* of the outdoor unit 2*a*, one end of the low-pressure gas branch pipe 31*a* is coupled. To the closing valve 45*b* of the outdoor unit 2*b*, one end of the low-pressure gas branch pipe 31*b* is coupled. The other end of the low-pressure gas branch pipe 31*a* and the other end of the low-pressure gas branch pipe 31*b* are coupled to the branching unit 71. To the branching unit 71, one end of the low-pressure gas pipe 31 is coupled. The other end of the low-pressure gas pipe 31 is branched and coupled to the second diversion pipes 64*a* to 64*e* of the switching units 6*a* to 6*e*.

To the closing valve 46*a* of the outdoor unit 2*a*, one end of the liquid branch pipe 32*a* is coupled. To the closing valve 46*b* of the outdoor unit 2*b*, one end of the liquid branch pipe 32*b* is coupled. The other end of the liquid branch pipe 32*a* and the other end of the liquid branch pipe 32*b* are coupled to the branching unit 72. To the branching unit 72, one end of the liquid pipe 32 is coupled. The other end of the liquid pipe 32 is branched and coupled to the refrigerant pipes to the indoor expansion valves 82*a* to 82*e* of the indoor units 8*a* to 8*e*.

The indoor heat exchangers 81*a* to 81*e* of the indoor units 8*a* to 8*e* are coupled to the coupling points between the first diversion pipes 63*a* to 63*e* and the second diversion pipes 64*a* to 64*e* of the corresponding switching units 6*a* to 6*e* via refrigerant pipes.

Via the above-described couplings, a refrigerant circuit of the air-conditioning apparatus 1 is configured. By causing refrigerant to flow in the refrigerant circuit, a refrigeration cycle can be implemented.

An operation of the air-conditioning apparatus 1 according to the present example will be described with reference to FIG. 1. In FIG. 1, the heat exchangers in the outdoor units 2*a* and 2*b* and the indoor units 8*a* to 8*e* that are used as condensers are indicated by hatching. The heat exchangers used as evaporators are indicated without hatching. With regard to the open/close state of the first electromagnetic valve 42*a* and the second electromagnetic valve 43*a* of the outdoor unit 2*a*, the first electromagnetic valve 42*b* and the second electromagnetic valve 43*b* of the outdoor unit 2*b*, and the electromagnetic valves 61*a* to 61*e* and the electromagnetic valves 62*a* to 62*e* of the switching units 6*a* to 6*e*, the valves being closed are indicated by solid areas, while the valves being opened are indicated by blanks.

The arrows in the drawing indicate the flow of the refrigerant.

In the example of FIG. 1, the indoor units 8*a* to 8*c* are performing the cooling operation while the indoor units 8*d* and 8*e* are performing the heating operation. When the operation capacity (cooling capacity) required from the indoor units 8*a* to 8*c* is greater than the operation capacity (heating capacity) required from the indoor units 8*d* and 8*e*, the air-conditioning apparatus 1 performs the cooling-main operation. In this case, the first three-way valve 22*a* of the outdoor unit 2*a* is switched to provide communication between the port a and the port b. Thus, the first outdoor heat exchanger 24*a* serves as a condenser. The second three-way valve 23*a* of the outdoor unit 2*a* is switched to provide communication between the port d and the port e. Thus, the second outdoor heat exchanger 25*a* serves as a condenser. The first three-way valve 22*b* of the outdoor unit 2*b* is switched to provide communication between the port g and the port h. Thus, the first outdoor heat exchanger 24*b* serves as a condenser. The second three-way valve 23*b* of the outdoor unit 2*b* is switched to provide communication between the port k and the port m. Thus, the second outdoor heat exchanger 25*b* serves as a condenser. The first electromagnetic valve 42*a* and the second electromagnetic valve 43*a* of the outdoor unit 2*a* are both closed. Similarly, the first electromagnetic valve 42*b* and the second electromagnetic valve 43*b* of the outdoor unit 2*b* are both closed. The hot gas bypass pipes 36*a* and 36*b* and the oil return pipes 37*a* and 37*b* are in a state such that neither refrigerant nor refrigerant oil flows therein.

The electromagnetic valves 61*a* to 61*c* of the switching units 6*a* to 6*c* corresponding to the indoor units 8*a* to 8*c* that perform the cooling operation are closed to stop the flow of refrigerant in the first diversion pipes 63*a* to 63*c*. At the same time, the electromagnetic valves 62*a* to 62*c* are opened to allow the flow of refrigerant in the second diversion pipes 64*a* to 64*c*. Thus, the indoor heat exchangers 81*a* to 81*c* of the indoor units 8*a* to 8*c* serve as evaporators On the other hand, the electromagnetic valves 61*d* and 61*e* of the switching units 6*d* and 6*e* corresponding to the indoor units 8*d* and 8*e* that perform the heating operation are opened, so that refrigerant flows in the first diversion pipes 63*d* and 63*e*. The electromagnetic valves 62*d* and 62*e* are closed, whereby the flow of refrigerant in the second diversion pipes 64*d* and 64*e* is stopped. Thus, the indoor heat exchangers 81*d* and 81*e* of the indoor units 8*d* and 8*e* serve as condensers.

The high-pressure refrigerant discharged from the compressor 21*a* flows in the outdoor unit high-pressure gas pipe 33*a* via the oil separator 28*a*. The high-pressure refrigerant is divided at the coupling point A toward the first three-way valve 22*a* and the second three-way valve 23*a* and toward the closing valve 44*a*. Similarly, the high-pressure refrigerant discharged from the compressor 21*b* flows in the outdoor unit high-pressure gas pipe 33*b* via the oil separator 28*b*. The refrigerant is divided at the coupling point H toward the first three-way valve 22*b* and the second three-way valve 23*b* and toward the closing valve 44*b*.

The refrigerant that has flowed into the first outdoor heat exchanger 24*a* via the first three-way valve 22*a*, and the refrigerant that has flowed into the second outdoor heat exchanger 25*a* via the second three-way valve 23*a* exchanges heat with the open-air, whereby the refrigerant is condensed.

The refrigerant condensed in the first outdoor heat exchanger 24*a* is passed through the first outdoor expansion valve 40*a* and turned into intermediate-pressure refrigerant. The degree of opening of the first outdoor expansion valve 40*a* is set by the CPU 110*a* in accordance with the refrigerant subcooling degree at the exit of the first outdoor heat exchanger 24*a*. The refrigerant subcooling degree is calculated, for example, by using the high pressure saturation temperature calculated on the basis of the pressure detected by the high pressure sensor 50*a* (corresponding to the condensation temperature at the first outdoor heat exchanger 24*a*), and the refrigerant temperature detected by the first liquid side refrigerant temperature sensor 59*a*.

The refrigerant condensed in the second outdoor heat exchanger 25*a* is passed through the second outdoor expansion valve 41*a* and turned into intermediate-pressure refrigerant. The degree of opening of the second outdoor expansion valve 41*a* is set by the CPU 110*a* in accordance with the refrigerant subcooling degree at the exit of the second outdoor heat exchanger 25*a*. The refrigerant subcooling degree is calculated by, for example, using the high pressure saturation temperature calculated on the basis of the pressure detected by the high pressure sensor 50*a* (corresponding to the condensation temperature at the second outdoor heat exchanger 25*a*), and the refrigerant temperature detected by the second liquid-side refrigerant temperature sensor 60*a*.

The refrigerant that has flowed into the first outdoor heat exchanger 24*b* via the first three-way valve 22*b* and the refrigerant that has flowed into the second outdoor heat exchanger 25*b* via the second three-way valve 23*b* exchange heat with the open-air, whereby the refrigerants are condensed. The refrigerant condensed in the first outdoor heat exchanger 24*b* is passed through the first outdoor expansion valve 40*b* and turned into intermediate-pressure refrigerant. The degree of opening of the first outdoor expansion valve 40*b* is set by the CPU 110*b* in accordance with the refrigerant subcooling degree at the exit of the first outdoor heat exchanger 24*b*. The refrigerant subcooling degree is calculated by, for example, using the high pressure saturation temperature calculated on the basis of the pressure detected by the high pressure sensor 50*b* (corresponding to the condensation temperature at the first outdoor heat exchanger 24*b*) and the refrigerant temperature detected by the first liquid side refrigerant temperature sensor 59*b*.

The refrigerant condensed in the second outdoor heat exchanger 25*b* is passed through the second outdoor expansion valve 41*b* and turned into intermediate-pressure refrigerant. The degree of opening of the second outdoor expansion valve 41*b* is set by the CPU 110*b* in accordance with the refrigerant subcooling degree at the exit of the second outdoor heat exchanger 25*b*.

The refrigerant subcooling degree is calculated by, for example, using the high pressure saturation temperature calculated on the basis of the pressure detected by the high pressure sensor 50*b* (corresponding to the condensation temperature at the second outdoor heat exchanger 25*b*) and the refrigerant temperature detected by the second liquid-side refrigerant temperature sensor 60*b*.

The refrigerant that has passed through the first outdoor expansion valve 40*a* and the refrigerant that has passed through the second outdoor expansion valve 41*a* converge at the coupling point B and then flow into the outdoor unit liquid pipe 35*a*. The refrigerant further flows into the liquid branch pipe 32*a* via the closing valve 46*a*. The refrigerant that has passed through the first outdoor expansion valve 40*b* and the refrigerant that has passed through the second outdoor expansion valve 41*b* converge at the coupling point J and then flow into the outdoor unit liquid pipe 35*b*. The refrigerant further flows into the liquid branch pipe 32*b* via the closing valve 46*b*. The refrigerants that flow in the liquid branch pipes 32*a* and 32*b* converge in the branching unit 72 and then flow into the indoor units 8*a* to 8*c* via the liquid pipe 32.

The refrigerant that has flowed into the indoor units 8*a* to 8*c* has its pressure reduced by the corresponding indoor expansion valves 82*a* to 82*c*, whereby low-pressure refrigerant is produced. The low-pressure refrigerant flows into the indoor heat exchangers 81*a* to 81*c*. The refrigerant that has flowed into the indoor heat exchangers 81*a* to 81*c* exchanges heat with the indoor air and is thereby evaporated. Thus, the indoor spaces in which the indoor units 8*a* to 8*c* are installed are cooled. The degree of opening of the indoor expansion valves 82*a* to 82*c* is determined in accordance with the degree of superheating of refrigerant at the refrigerant exit of the indoor heat exchangers 81*a* to 81*c*. The degree of superheating of refrigerant is determined by, for example, subtracting the refrigerant temperature at the refrigerant entry of the indoor heat exchangers 81*a* to 81*c* that is detected by the refrigerant temperature sensors 84*a* to 84*c* from the refrigerant temperature at the refrigerant exit of the indoor heat exchangers 81*a* to 81*c* that is detected by the refrigerant temperature sensors 85*a* to 85*c*.

The refrigerant that has flowed out of the indoor heat exchangers 81*a* to 81*c* flows into the corresponding switching units 6*a* to 6*c*. The refrigerant flows through the second diversion pipes 64*a* to 64*c* provided with the open electromagnetic valves 62*a* to 62*c* and then flows into the low-pressure gas pipe 31. The refrigerant that has flowed into the branching unit 71 through the low-pressure gas pipe 31 is divided at the branching unit 71 into the low-pressure gas branch pipe 31*a* and the low-pressure gas branch pipe 31*b*. The refrigerant that has flowed into the low-pressure gas branch pipe 31*a* flows into the outdoor unit 2*a* via the closing valve 45*a*. The refrigerant that has flowed into the outdoor unit 2*a* flows in the outdoor unit low-pressure gas pipe 34*a*. The refrigerant is suctioned by the compressor 21*a* via the accumulator 27*a* and compressed again. The refrigerant that has flowed into the low-pressure gas branch pipe 31*b* flows into the outdoor unit 2*b* via the closing valve 45*b*. The refrigerant that has flowed into the outdoor unit 2*b* flows in the outdoor unit low-pressure gas pipe 34*b*. The refrigerant is suctioned by the compressor 21*b* via the accumulator 27*b* and compressed again.

Meanwhile, the high-pressure refrigerant that has flowed from the coupling point A into the outdoor unit high-pressure gas pipe 33*a* and flowed into the high-pressure gas branch pipe 30*a* via the closing valve 44*a*, and the high-pressure refrigerant that has flowed from the coupling point H into the outdoor unit high-pressure gas pipe 33*b* and flowed into the high-pressure gas branch pipe 30*b* via the closing valve 44*b* converge in the branching unit 70. The converged high-pressure refrigerant flows through the high-pressure gas pipe 30 into the switching unit 6*d* and the switching unit 6*e*.

The high-pressure refrigerant that has flowed into the switching unit 6*d* flows through the first diversion pipe 63*d* with the open electromagnetic valve 61*d* and then flows out of the switching unit 6*d*. The high-pressure refrigerant then flows into the indoor unit 8*d* corresponding to the switching unit 6*d*. The high-pressure refrigerant that has flowed into the indoor heat exchanger 81*d* exchange heat with the indoor air and is thereby condensed. The high-pressure refrigerant that has flowed into the switching unit 6*e* flows through the first diversion pipe 63*e* with the open electromagnetic valve 61*e* and then flows out of the switching unit 6*e*. The high-pressure refrigerant then flows into the indoor unit 8*e* corresponding to the switching unit 6*e*. The high-pressure refrigerant exchange heat with the indoor air in the indoor heat exchanger 81*e* and is thereby condensed. Thus, the indoor air is heated, whereby the indoor spaces in which the indoor units 8*d* and 8*e* are installed are heated.

The high-pressure refrigerant that has flowed out of the indoor heat exchanger 81*d* is passed through the indoor expansion valve 82*d* and depressurized. The degree of opening of the indoor expansion valve 82*d* is determined in accordance with the subcooling degree of the refrigerant at the refrigerant exit of the indoor heat exchanger 81*d*. The high-pressure refrigerant that has flowed out of the indoor heat exchanger 81*e* is passed through the indoor expansion valve 82*e* and depressurized. The degree of opening of the indoor expansion valve 82*e* is determined in accordance with the subcooling degree of the refrigerant at the refrigerant exit of the indoor heat exchanger 81*e*. The subcooling degree of the refrigerant is calculated by, for example, subtracting the refrigerant temperature at the refrigerant exit of the indoor heat exchanger 81*d* or the indoor heat exchanger 81*e* that is detected by the refrigerant temperature sensor 84*d* or the temperature sensor 84*e*, from the high pressure saturation temperature calculated from the pressure detected by the high pressure sensor 50*a* of the outdoor unit 2*a* and the high pressure sensor 50*b* of the outdoor unit 2*b* (corresponding to the condensation temperature in the indoor heat exchangers 81*d* and 81*e*).

The refrigerant that has flowed out of the indoor unit 8*d* via the indoor expansion valve 82*d* and the refrigerant that has flowed out of the indoor unit 8*e* via the indoor expansion valve 82*e* flow through the liquid pipe 32 into the indoor units 8*a* to 8*c* performing the cooling operation.

The operation, function, and effect of the refrigerant circuit of the air-conditioning apparatus 1 will be described with reference to FIGS. 1 to 3. First, with reference to FIGS. 1 and 2, the cause of refrigerant stagnation that occurs in the unused outdoor heat exchanger when the air-conditioning apparatus 1 is performing the cooling-main operation will be described.

Figure 2:
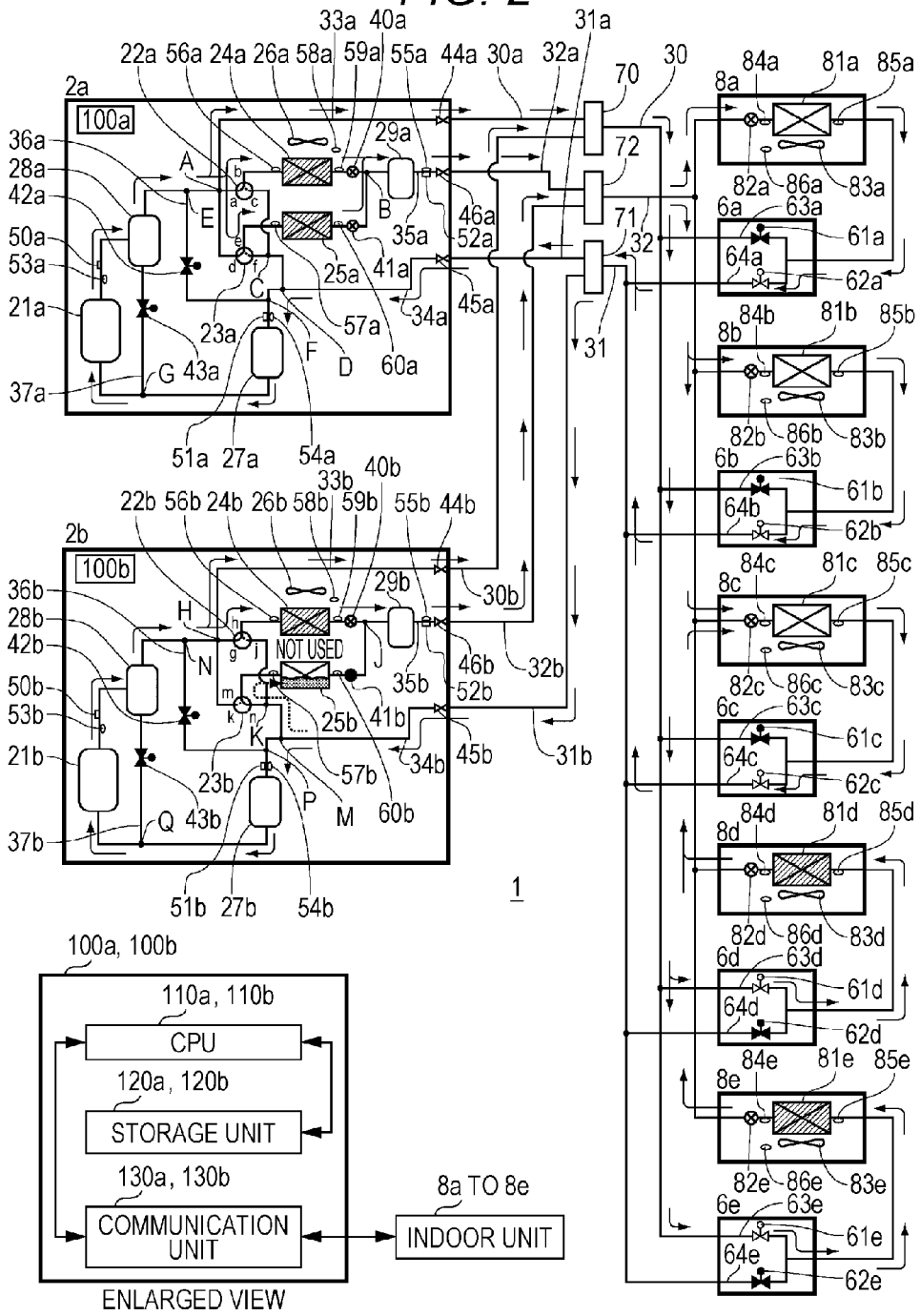
FIG. 2 is a refrigerant circuit diagram illustrating a flow of refrigerant in the presence of an outdoor heat exchanger at rest according to the example of the present disclosure.
Figure 3:
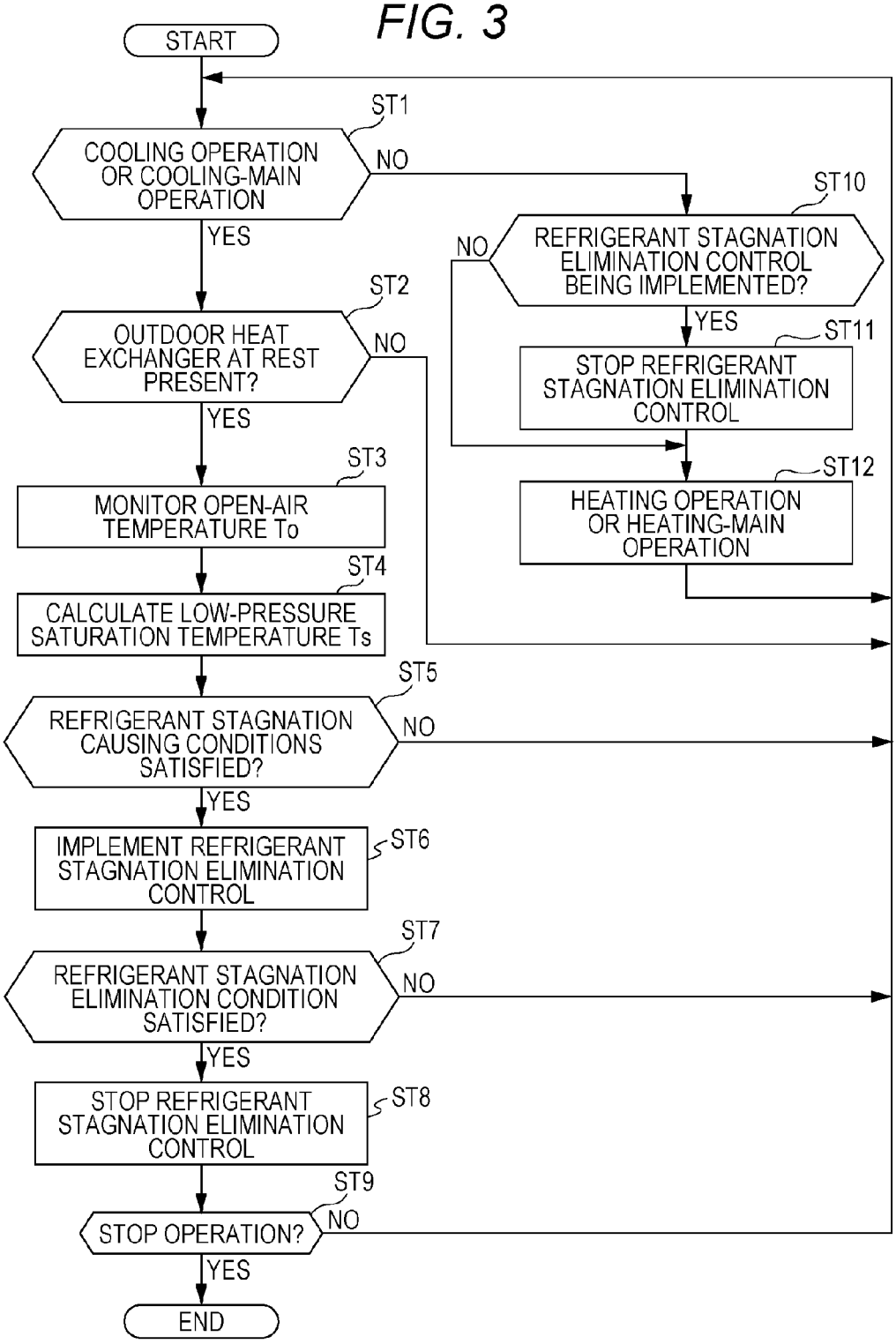
FIG. 3 is a flowchart illustrating a process (refrigerant stagnation elimination control) performed by a control means according to the example of the present disclosure.

The air-conditioning apparatus 1 directed in FIG. 2 is performing the cooling-main operation, as in FIG. 1. In the example of FIG. 2, the refrigerant circuit is switched such that the second outdoor heat exchanger 25*b* of the outdoor unit 2*b* is not used. Specifically, the refrigerant circuit is switched so as to provide communication between the port m and the port n of the second three-way valve 23*b*. The second outdoor heat exchanger 25*b* is coupled to the low-pressure side (outdoor unit low-pressure gas pipe 34*b*). The second outdoor expansion valve 41*b* is fully closed (blackened out in FIG. 2).

The control not to use the second outdoor heat exchanger 25*b* of the outdoor unit 2*b* as described above or the control to decrease the number of the outdoor exchange heaters serving as condensers is effectively performed, for example, when the low pressure is difficult to be controlled by the compressors 21*a* and 21*b* or when the condensation capacity is excessive.

There may be a case where the rotation speed of the compressors 21*a* and 21*b* is increased to a performance upper-limit rotation speed so as to increase the high pressure in a low open-air temperature state. In such a case, because the low pressure is decreased as a result, it is preferable to increase the low pressure to a target low pressure. Thus, condensation capacity can be lowered by decreasing the number of the outdoor heat exchangers serving as condensers. In this way, the low pressure can be increased.

There may be a case where the condensation capacity of the indoor heat exchangers 81*d* and 81*e*, the first outdoor heat exchangers 24*a* and 24*b*, and the second outdoor heat exchangers 25*a* and 25*b* that are serving as condensers is excessive compared with the evaporation capacity of the indoor heat exchangers 81*a* to 81*c* serving as evaporators. In this case, condensation capacity is preferably decreased by decreasing the number of the outdoor heat exchangers serving as condensers.

When the refrigerant circuit of the air-conditioning apparatus 1 is in the state illustrated in FIG. 2, some of the refrigerant that has flowed into the outdoor unit 2*b* via the low-pressure gas branch pipe 31*b* is divided at the coupling point M of the outdoor unit low-pressure gas pipe 34*b* toward the second three-way valve 23*b*. The divided refrigerant flows into the second outdoor heat exchanger 25*b* (indicated by a broken line arrow in FIG. 2). Because the second outdoor expansion valve 41*b* is fully closed, the refrigerant that has flowed into the second outdoor heat exchanger 25*b* remains in the second outdoor heat exchanger 25*b*.

In this case, when the following conditions (refrigerant stagnation causing conditions) are satisfied, the refrigerant may be stagnated within the second outdoor heat exchanger 25*b*. The refrigerant stagnation causing conditions include an open-air temperature To detected by the open-air temperature sensor 58*a* and/or 58*b* being lower than a low pressure saturation temperature Ts calculated from the pressure detected by the low pressure sensor 51*a* and/or 51*b* (Ts corresponding to the evaporation temperature at the indoor heat exchangers 81*a* to 81*c* serving as evaporators). The refrigerant stagnation causing conditions also include the state in which the operation capacity of the compressor 21*a* and/or 21*b* cannot be increased (such as when the rotation speed of the compressor 21*a* and/or 21*b* is increased to the performance upper-limit rotation speed as described above); namely, the state in which the low pressure saturation temperature Ts cannot be lowered because the low pressure cannot be lowered. The refrigerant stagnation causing conditions further include such state continuing for a predetermined time (such as 10 minutes) or more. When these conditions are satisfied, the refrigerant remaining in the second outdoor heat exchanger 25*b* may be condensed and stagnated within the second outdoor heat exchanger 25*b*.

If such state continues for a long time and the amount of refrigerant stagnated in the second outdoor heat exchanger 25*b* at rest is increased, the amount of refrigerant circulating through the refrigerant circuit is decreased. As a result, the amount of refrigerant that flows through the indoor units 8*a* to 8*e* is decreased, resulting in a decrease in cooling capacity or heating capacity.

Control of the air-conditioning apparatus 1 in this regard will be described. For example, suppose that the refrigerant stagnation causing conditions are satisfied during the cooling operation or the cooling-main operation in a state where there is an unused outdoor heat exchanger. In this case, in the air-conditioning apparatus 1, all of the outdoor heat exchangers including the unused outdoor heat exchanger are caused to serve as condensers. Namely, refrigerant stagnation elimination control for causing the refrigerant stagnated in the unused outdoor heat exchanger to flow out of the outdoor heat exchanger is implemented.

In the following, the refrigerant stagnation elimination control will be described in detail with reference to FIG. 3. FIG. 3 is a flowchart illustrating the flow of processing of the refrigerant stagnation elimination control, in which ST stands for step and the associated number indicates the step number. The following description with reference to FIG. 3 is focused mainly on processing involved with the essential part of the refrigerant stagnation elimination control. The description of other general processing, e.g., controlling a refrigerant circuit to reach a temperature set by the user or controlling the indoor fans 83*a* to 83*e* to provide air volume set by the user, will be omitted.

First, the CPUs 110*a* and 110*b* monitors the operation mode or operation capacity required by the users of the indoor units 8*a* to 8*e* via the communication units 130*a* and 130*b*. The CPUs 110*a* and 110*b* then determine whether the cooling operation or the cooling-main operation is to be performed (ST1).

When neither the cooling operation nor the cooling-main operation is to be performed (No in ST1), the CPUs 110*a* and 110*b* determine whether the refrigerant stagnation elimination control is being carried out (ST10). When the refrigerant stagnation elimination control is not being carried out (No in ST10), the CPUs 110*a* and 110*b* advance to ST12. When the refrigerant stagnation elimination control is being carried out (Yes in ST10), the CPUs 110*a* and 110*b* terminate the refrigerant stagnation elimination control (ST11). The CPU 110*a* then switches the first three-way valve 22*a* and the second three-way valve 23*a* of the outdoor unit 2*a*, and implements the heating operation or the heating-main operation. Similarly, the CPU 110*b* switches the first three-way valve 22*b* and the second three-way valve 23*b* of the outdoor unit 2*b*, and implement the heating operation or the heating-main operation (ST12).

Specifically, the CPU 110*a* switches the first three-way valve 22*a* so as to provide communication between the port b and the port c. Also, the CPU 110*a* switches the second three-way valve 23*a* so as to provide communication between the port e and the port f (the state indicated by broken lines in FIG. 1). Thus, the first outdoor heat exchanger 24*a* and the second outdoor heat exchanger 25*a* serve as evaporators. Then, the CPU 110*a* drives the compressor 21*a* at the rotation speed corresponding to the required operation capacity. Also, the CPU 110*a* sets the degree of opening of the first outdoor expansion valve 40*a* to the degree of opening corresponding to the degree of superheating of refrigerant at the exit of the first outdoor heat exchanger 24*a*. The CPU 110*a* sets the degree of opening of the second outdoor expansion valve 41*a* to the degree of opening corresponding to the degree of superheating of refrigerant at the exit of the second outdoor heat exchanger 25*a*.

The degree of superheating of refrigerant can be determined by using the low pressure saturation temperature calculated on the basis of the pressure detected by the low pressure sensor 51*a*, and the refrigerant temperature detected by the first gas side refrigerant temperature sensor 56*a* and/or the refrigerant temperature detected by the second gas side refrigerant temperature sensor 57*a*, for example. The CPU 110*a* determines the degree of superheating of refrigerant periodically (such as at 30 second intervals), and adjusts the degree of opening of the first outdoor expansion valve 40*a* and/or the degree of opening of the second outdoor expansion valve 41*a*.

Similarly, the CPU 110*b* switches the first three-way valve 22*b* to provide communication between the port h and the port j. Also, the CPU 110*b* switches the second three-way valve 23*b* to provide communication between the port m and the port n (the state indicated by broken lines in FIG. 1). Thus, the first outdoor heat exchanger 24*b* and the second outdoor heat exchanger 25*b* serve as evaporators. The CPU 110*b* then drives the compressor 21*b* at the rotation speed corresponding to the required operation capacity. Also, the CPU 110*b* sets the degree of opening of the first outdoor expansion valve 40*b* to the degree of opening corresponding to the degree of superheating of refrigerant at the exit of the first outdoor heat exchanger 24*b*. The CPU 110*b* sets the degree of opening of the second outdoor expansion valve 41*b* to the degree of opening corresponding to the degree of superheating of refrigerant at the exit of the second outdoor heat exchanger 25*b*.

The degree of superheating of refrigerant can be calculated by using the low pressure saturation temperature calculated on the basis of the pressure detected by the low pressure sensor 51*b*, and the refrigerant temperature detected by the first gas side refrigerant temperature sensor 56*b* and/or by the second gas side refrigerant temperature sensor 57*b*, for example. The CPU 110*b* determines the degree of superheating of refrigerant periodically (such as at 30 second intervals), and adjusts the degree of opening of the first outdoor expansion valve 40*b* and/or the degree of opening of the second outdoor expansion valve 41*b*.

The CPUs 110*a* and 110*b* control the corresponding outdoor units 2*a* and 2*b* as described above to implement the heating operation or the heating-main operation, and then return the process to ST1.

When the cooling operation or the cooling-main operation is to be performed (Yes in ST1), the CPUs 110*a* and 110*b* determine whether there is the outdoor heat exchanger that is not used (ST2). When there is no unused outdoor heat exchanger (when all of the outdoor heat exchangers are in operation; No in ST2), the refrigerant circuit of the air-conditioning apparatus 1 is in the state illustrated in FIG. 1. In this case, the CPUs 110*a* and 110*b* control the constituent elements of the outdoor units 2*a* and 2*b* as described above and implements the cooling operation or the cooling-main operation, and then return the process to ST1.

When there is the unused outdoor heat exchanger (Yes in ST2), the refrigerant circuit of the air-conditioning apparatus 1 is in the state illustrated in FIG. 2, for example. Specifically, the first three-way valve 22*a* of the outdoor unit 2*a* is switched to provide communication between the port a and the port b. Also, the second three-way valve 23*a* is switched to provide communication between the port d and the port e (the state indicated by solid lines in FIG. 2). Thus, the first outdoor heat exchanger 24*a* and the second outdoor heat exchanger 25*a* serve as condensers.

Further, the first three-way valve 22*b* of the outdoor unit 2*b* is switched to provide communication between the port g and the port h. Also, the second three-way valve 23*b* is switched to provide communication between the port m and the port n (the state indicated by solid lines in FIG. 2). Thus, the first outdoor heat exchanger 24*b* serves as a condenser while the second outdoor heat exchanger 25*b* is in an unused state.

In the above refrigerant circuit, the CPU 110*a* drives the compressor 21*a* at the rotation speed corresponding to the required operation capacity. Also, the CPU 110*a* sets the degree of opening of the first outdoor expansion valve 40*a* and the second outdoor expansion valve 41*a* to the degree of opening corresponding to the refrigerant subcooling degree at the exit of the first outdoor heat exchanger 24*a* and the second outdoor heat exchanger 25*a*. The refrigerant subcooling degree can be determined by, for example, using the high pressure saturation temperature calculated on the basis of the pressure detected by the high pressure sensor 50*a* and the refrigerant temperature detected by the first liquid side refrigerant temperature sensor 59*a* and/or the second liquid-side refrigerant temperature sensor 60*a*. The CPU 110*a* determines the refrigerant subcooling degree periodically (such as at 30 second intervals), and adjusts the degree of opening of the first outdoor expansion valve 40*a* and/or the second outdoor expansion valve 41*a*.

Further, the CPU 110*b* drives the compressor 21*b* at the rotation speed corresponding to the required operation capacity. Also, the CPU 110*b* sets the degree of opening of the first outdoor expansion valve 40*b* to the degree of opening corresponding to the refrigerant subcooling degree at the exit of the first outdoor heat exchanger 24*b* and the second outdoor heat exchanger 25*b*. The CPU 110*b* also fully closes the second outdoor expansion valve 41*b*. The refrigerant subcooling degree can be determined by using, for example, the high pressure saturation temperature calculated on the basis of the pressure detected by the high pressure sensor 50*b*, and the refrigerant temperature detected by the first liquid side refrigerant temperature sensor 59*b* and/or the second liquid-side refrigerant temperature sensor 60*b*. The CPU 110*b* determines the refrigerant subcooling degree periodically (such as at 30 second intervals), and adjusts the degree of opening of the first outdoor expansion valve 40*b*.

The CPUs 110*a* and 110*b* control the corresponding outdoor units 2*a* and 2*b* as described above to implement the cooling-main operation.

Next, the CPUs 110*a* and 110*b* monitor the open-air temperature To detected by the open-air temperature sensors 58*a* and 58*b* (ST3). Also, the CPUs 110*a* and 110*b* monitor the pressure detected by the low pressure sensors 51*a* and 51*b*. The CPUs 110*a* and 110*b* calculate the low pressure saturation temperature Ts by using the monitored pressure (ST4). The CPUs 110*a* and 110*b* conduct the monitoring of the open-air temperature To and the calculation of the low pressure saturation temperature Ts periodically (such as at five intervals).

Next, the CPUs 110*a* and 110*b* determine whether the refrigerant stagnation causing conditions are satisfied (ST5). As described above, the refrigerant stagnation causing conditions are used to determine the probability of refrigerant stagnation in the second outdoor heat exchanger 25*b* at rest. The refrigerant stagnation causing conditions include, as described above, whether the monitored open-air temperature To is lower than the calculated low pressure saturation temperature Ts, and whether the state in which the operation capacity of the compressors 21*a* and 21*b* cannot be increased continues for a predetermined time, such as 10 minutes, or longer.

When the refrigerant stagnation causing conditions are not satisfied (No in ST5), the CPUs 110*a* and 110*b* return the process to ST1. When the refrigerant stagnation causing conditions are satisfied (Yes in ST5), the CPUs 110*a* and 110*b* implement the refrigerant stagnation elimination control (ST6). The refrigerant stagnation elimination control involves causing all of the outdoor heat exchangers including the outdoor heat exchanger at rest to serve as condensers, so that the refrigerant stagnated in the unused outdoor heat exchanger can flow out of the outdoor heat exchanger. According to the present example, the second outdoor heat exchanger 25*b* at rest is caused to serve as a condenser. Thus, the CPU 110*b* controls the second three-way valve 23*b* and the second outdoor expansion valve 41*b*.

Specifically, the CPU 110*b* switches the second three-way valve 23*b* to provide communication between the port k and the port m. The CPU 110*b* also sets the degree of opening of the second outdoor expansion valve 41*b* to the degree of opening corresponding to the refrigerant subcooling degree at the exit of the second outdoor heat exchanger 25*b*. Thus, the second outdoor heat exchanger 25*b* serves as a condenser. Thus, all of the outdoor heat exchangers (the first outdoor heat exchangers 24*a* and 24*b*, and the second outdoor heat exchangers 25*a* and 25*b*) serve as condensers. Namely, the refrigerant circuit illustrated in FIG. 1 is realized.

As described above, in the air-conditioning apparatus 1, the refrigerant stagnation elimination control such that the unused second outdoor heat exchanger 25*b* is caused to serve as a condenser is implemented. As a result, the refrigerant stagnated in the second outdoor heat exchanger 25*b* can be caused to flow out of the second outdoor heat exchanger 25*b*. The refrigerant then flows out of the outdoor unit 2*b* via the second outdoor expansion valve 41*b* and through the outdoor unit liquid pipe 35*b*. Thus, refrigerant stagnation in the second outdoor heat exchanger 25*b* can be eliminated.

The CPUs 110*a* and 110*b*, during the refrigerant stagnation elimination control, increase and decrease the rotation speed of the outdoor fans 26*a* and 26*b* between zero and 900 rpm at a predetermined rate (such as 100 rpm/20 sec) for the following reason. When the refrigerant stagnation elimination control is being implemented, the number of the condensers is increased compared to the refrigerant circuit illustrated in FIG. 2. This is because the unused second outdoor heat exchanger 25*b* is caused to serve as a condenser. As a result, the condensation capacity becomes excessive, and the high pressure (the pressure of the refrigerant in the high-pressure gas pipe 30, the high-pressure gas branch pipes 30*a* and 30*b*, and the outdoor unit high-pressure gas pipes 33*a* and 33*b*) is lowered. The high pressure may even be lowered below the target high pressure for achieving the desired heating capacity in the indoor units 8*d* and 8*e* performing the heating operation. The target high pressure is for ensuring a pressure difference from the pressure of the refrigerant (liquid pressure) flowing in the liquid pipe 32 and the liquid branch pipes 32*a* and 32*b*.

The CPUs 110*a* and 110*b* periodically monitor the high pressure detected by the high pressure sensors 50*a* and 50*b*. The CPUs 110*a* and 110*b* cause the rotation speed of the outdoor fans 26*a* and 26*b* to be varied between 0 and 900 rpm in accordance with the pressure difference between the monitored high pressure and the target high pressure. For example, when the high pressure drops below the target high pressure due to the increase in the number of the outdoor heat exchangers serving as gas condensers with the resultant excess condensation capacity, the CPUs 110*a* and 110*b* cause the rotation speed of the outdoor fans 26*a* and 26*b* to be decreased at a predetermined rate. Namely, the CPUs 110*a* and 110*b* decrease the ventilation volume in each of the outdoor heat exchangers. Thus, the condensation capacity in each outdoor heat exchanger is lowered, and the high pressure is increased. Thus, the decrease in high pressure due to excess condensation capacity can be mitigated or eliminated, so that the decrease in heating capacity in the indoor units 8*d* and 8*e* performing the heating operation can be suppressed.

Next, the CPUs 110*a* and 110*b* determine whether a refrigerant stagnation elimination condition is satisfied (ST7). The refrigerant stagnation elimination condition is such that refrigerant stagnation is not caused in the outdoor heat exchangers even if there is the unused outdoor heat exchanger. Specifically, the refrigerant stagnation elimination condition includes whether a state in which the temperature obtained by subtracting a predetermined temperature (such as 2° C.) from the monitored open-air temperature To is higher than the low pressure saturation temperature Ts has continued for a predetermined time, such as five minutes, or more. When the refrigerant stagnation elimination condition is satisfied, the probability of refrigerant stagnation in the unused outdoor heat exchanger, if any, can be relatively decreased.

As described above, the refrigerant stagnation elimination condition involves the comparison of the temperature obtained by subtracting a predetermined temperature from the open-air temperature To and the low pressure saturation temperature Ts. If, as the refrigerant stagnation eliminating condition, the open-air temperature To and the low pressure saturation temperature Ts are compared without subtracting the predetermined temperature from the open-air temperature To and the refrigerant stagnation elimination control is stopped, the refrigerant stagnation causing condition may be satisfied again soon thereafter, followed by the implementation of the refrigerant stagnation elimination control, and this may occur frequently. Thus, in order to prevent this, the temperature obtained by subtracting a predetermined temperature from the open-air temperature To is compared with the low pressure saturation temperature Ts.

When the refrigerant stagnation eliminating condition is not satisfied (No in ST7), the CPUs 110*a* and 110*b* return the process back to ST1. When the refrigerant stagnation eliminating condition is satisfied (Yes in ST7), the CPUs 110*a* and 110*b* terminate the refrigerant stagnation elimination control (ST8).

Then, the CPUs 110*a* and 110*b* determine whether, given the operation of all of the indoor units 8*a* to 8*e* is stopped, the operation of the outdoor units 2*a* and 2*b* are to be stopped (ST9). When the operation is to be stopped (Yes in ST9), the CPUs 110*a* and 110*b* cause the corresponding compressor 21*a* or 21*b* to be stopped. Further, the CPUs 110*a* and 110*b* cause the corresponding first outdoor expansion valve 40*a* or 40*b*, and the corresponding second outdoor expansion valve 41*a* or 41*b* to be fully closed, and end the process. When the operation need not be stopped (No in ST9), the CPUs 110*a* and 110*b* return the process back to ST1.

As described above, the air-conditioning apparatus according to the present disclosure can suppress the stagnation of refrigerant in the outdoor heat exchanger at rest. Namely, when refrigerant stagnation occurs in the unused outdoor heat exchanger during the cooling operation or the cooling-main operation of the air-conditioning apparatus 1, all of the outdoor heat exchangers including the unused outdoor heat exchanger are caused to serve as condensers. Thus, the stagnated refrigerant can be caused to flow out of the outdoor heat exchanger, so that the refrigerant stagnation can be eliminated. Thus, the lack of refrigerant in the indoor units performing the cooling operation can be remedied, and, as a result, the decrease in cooling and/or heating capacity can be suppressed.

In the foregoing example, when the refrigerant stagnation causing conditions are satisfied, all of the outdoor heat exchangers including the unused outdoor heat exchanger are caused to serve as condensers. However, an outdoor fan may not be able to rotate due to a failure in its motor and the like. In such a case, the outdoor heat exchanger corresponding to the outdoor fan may preferably be not used as a condenser when the refrigerant stagnation elimination control is implemented.

The air-conditioning apparatus according to the present disclosure may be expressed as a first air-conditioning apparatus as follows. The first air-conditioning apparatus comprises: at least one outdoor unit including at least one compressor, an outdoor fan, a plurality of outdoor heat exchangers, a flow passage switching means coupled to one refrigerant inlet/outlet opening of each of the outdoor heat exchangers and configured to switch the coupling of the outdoor heat exchangers to a refrigerant discharge opening or a refrigerant intake opening of the compressor, a flow rate adjustment means coupled to another refrigerant inlet/outlet opening of each of the outdoor heat exchangers and configured to adjust the refrigerant flow rate in the outdoor heat exchangers, an open-air temperature detection means configured to detect an open-air temperature, a low-pressure detection means configured to detect the pressure on a low-pressure side of the compressor, and a control means configured to control the flow passage switching means or the flow rate adjustment means; a plurality of indoor units including an indoor heat exchanger; and a plurality of switching units corresponding to the plurality of the indoor units and configured to switch the direction of refrigerant flow in the indoor heat exchanger, wherein: the outdoor unit and the plurality of the switching units are coupled via a high-pressure gas pipe and a low-pressure gas pipe; the plurality of the indoor units is coupled to the at least one outdoor unit via a liquid pipe; the plurality of the indoor units and the corresponding plurality of the switching units are coupled via a refrigerant pipe; and the control means causes all of the outdoor heat exchangers to serve as condensers when the outdoor heat exchangers include an outdoor heat exchanger serving as a condenser and an outdoor heat exchanger at rest, and when a state in which the open-air temperature detected by the open-air temperature detection means is lower than a low pressure saturation temperature calculated by using the pressure on the low-pressure side which is detected by the low-pressure detection means continues for a predetermined time.

According to the first air-conditioning apparatus, when refrigerant stagnation is caused in the outdoor heat exchanger at rest during the cooling operation or the cooling-main operation by the outdoor heat exchanger serving as a condenser, all of the outdoor heat exchangers including the unused outdoor heat exchanger are caused to serve as condensers. In this way, the stagnated refrigerant can be caused to flow out of the outdoor heat exchanger so that the refrigerant stagnation can be eliminated. Thus, the lack of refrigerant in the indoor unit performing the cooling operation can be eliminated, and the decrease in cooling/heating capacity can be prevented.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outdoor unit for an air-conditioning apparatus, comprising:

a compressor;

an outdoor fan;

a plurality of outdoor heat exchangers coupled to a plurality of indoor units;

a switching member configured to switch functions of the outdoor heat exchangers to either condensers or evaporators by switching of coupling states between the compressor and the outdoor heat exchangers; and a control unit configured to calculate a low pressure saturation temperature during a cooling operation or a cooling-main operation, and configured to cause all of the plurality of outdoor heat exchangers to serve as condensers by controlling the switching member when a state in which an open-air temperature is lower than the low pressure saturation temperature continues for a predetermined time.

2. The outdoor unit according to claim 1, further comprising an open-air temperature detector configured to detect the open-air temperature.

3. The outdoor unit according to claim 1, further comprising a low-pressure detector configured to detect the pressure on a low-pressure side of the compressor, wherein the control unit calculates the low pressure saturation temperature based on the pressure on the low-pressure side.

4. The outdoor unit according to claim 1, wherein the switching member includes:

a flow passage switching unit configured to switch the coupling of one refrigerant inlet/outlet opening of the outdoor heat exchangers to a refrigerant discharge opening or a refrigerant intake opening of the compressor; and a flow rate adjustment unit coupled to another refrigerant inlet/outlet opening of the outdoor heat exchangers and configured to adjust the refrigerant flow rate in the outdoor heat exchangers.

5. The outdoor unit according to claim 4, wherein the flow passage switching unit is a three-way valve.

6. The outdoor unit according to claim 4, wherein the flow rate adjustment unit is an expansion valve.

7. The outdoor unit according to claim 1, further comprising a high-pressure detector that detects the pressure on a high-pressure side of the compressor, wherein the control unit causes the rotation speed of the outdoor fan to be decreased at a predetermined rate when the pressure on a high-pressure side is lower than a target high pressure.

8. An air-conditioning apparatus comprising:

the outdoor unit according to claim 1; and a plurality of indoor units coupled to the outdoor unit.

* * * * *